US008550159B2

(12) United States Patent
Fink

(10) Patent No.: US 8,550,159 B2
(45) **Date of Patent: *Oct. 8, 2013**

(54) DOWN-HOLE LIQUID LEVEL CONTROL FOR HYDROCARBON WELLS

(75) Inventor: Joseph M. Fink, Washington, PA (US)

(73) Assignee: CNX Gas Company LLC, Canonsburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/537,383

(22) Filed: Jun. 29, 2012

(65) Prior Publication Data

US 2012/0267092 A1 Oct. 25, 2012

Related U.S. Application Data

(63) Continuation of application No. 12/540,793, filed on Aug. 13, 2009, now Pat. No. 8,235,111.

(60) Provisional application No. 61/089,353, filed on Aug. 15, 2008.

(51) Int. Cl.
*E21B 43/12* (2006.01)

(52) U.S. Cl.
USPC ..... 166/250.15; 166/54; 166/372

(58) Field of Classification Search
USPC ..... 116/110, 228; 417/40; 166/250.15, 372, 166/54
See application file for complete search history.

(56) References Cited

U.S. PATENT DOCUMENTS

| | | | | |
|---|---|---|---|---|
| 4,943,210 | A * | 7/1990 | Bailey et al. | 417/12 |
| 5,911,278 | A * | 6/1999 | Reitz | 166/372 |
| 6,547,004 | B2 * | 4/2003 | Last et al. | 166/250.03 |

* cited by examiner

*Primary Examiner* — Cathleen Hutchins
(74) *Attorney, Agent, or Firm* — Beck & Thomas, P.C.

(57) ABSTRACT

This invention provides for an apparatus that controls a liquid level down-hole of a hydrocarbon producing well by physically monitoring the liquid level down-hole having a down-hole liquid level measurer and a signal device connected to the liquid level measurer that causes a pump to adjust its current liquid output based on the liquid level down-hole as measured by the down-hole liquid level measurer.

18 Claims, 8 Drawing Sheets

DOWN-HOLE LIQUID LEVEL CONTROL FOR HYDROCARBON WELLS

CROSS-REFERENCES TO RELATED APPLICATIONS

This application is a continuation of prior application Ser. No. 12/540,793, filed Aug. 13, 2009, now U.S. Pat. No. 8,235,111, issued Aug. 7, 2012, which claims the benefit of U.S. Provisional Application No. 61/089,353, filed Aug. 15, 2008. application Ser. No. 12/540,793, now U.S. Pat. No. 8,235,111, and U.S. Provisional Application No. 61/089,353 are hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION (1) Field of the Invention

This invention relates in general to a device and method for extracting liquid from a well.

(2) Description of the Related Art

When trying to produce natural gas from a well, often times, liquids from the desired formations are simultaneously produced with the natural gas. The production of this liquid can adversely affect the gas production if the liquid is allowed to build up within the well bore. In the case of an oil well, however, the liquid is the desired component to remove for sale. An example of the production of a liquid from a well is production of water within coal bed methane wells when producing methane.

The liquid produced is typically removed by a pump. The pump can be a submersible, sucker rod, positive displacement or any other type of down-hole pump. Often in the beginning of a coal bed methane well's life, water production is constant, but as the well ages the liquid production is reduced or intermittent therefore limiting the amount of time that the pump must run. If the pump removes all of the water from within the well bore and the pump continues to operate, it adversely affects or more rapidly diminishes the useful life of the pump. The operation of the pump without liquid could cause the pump to burn up or prematurely wear out. In addition to reducing the life or damaging the pump by dry or reduced flow operation, gas is allowed to escape into the liquid production tubing and into water tanks/pits or water/liquid lines. This ultimately leads to the gas being lost into the atmosphere.

One approach to solving the problem would be a human (well tender) programming a timing device to control the pump's on/off cycle. This on and off cycle is simply a human guess on how often the pump should pump or not pump based on pressures, flows, well age, etc. This is largely inaccurate and requires persons to constantly monitor and modify the cycles at each individual well site.

Another approach to solve the problem is to use physical data from the surface equipment to control when the pump turns on/off. However, this can be very difficult or impossible to achieve. These controllers look at the following types of data among others:

(1) how much pressure is on the well bore;
(2) the depth of the well;
(3) the weight of the liquid being lifted;
(4) a load sensor on the pumping unit;
(5) the power consumed by the pumping unit; and/or
(6) the production of the well.

All of these controllers are located on the surface and often times are not reliable.

BRIEF SUMMARY OF THE INVENTION

This invention provides for an apparatus that controls a liquid level down-hole of a hydrocarbon producing well by monitoring the liquid level down-hole having a down-hole liquid level measurer and a signal device connected to the liquid level measurer that causes a pump to adjust its current liquid output based on the liquid level down-hole as measured by the down-hole liquid level measurer. Monitoring the liquid level down-hole in the well can be done physically.

The liquid level measurer can have a support structure and a float connected to the support structure so that it is able to move vertically up and down the support structure and its position is determined by the liquid level down-hole.

The signal device can have a top target connected to the float; a bottom target connected to the float; an upper sensing device connected to an upper support structure so that when the liquid level down-hole causes the float to rise vertically, the top target engages the upper sensing device thereby initiating an increase in the amount of liquid removed from the well; and a lower sensing device connected to a lower support structure so that when the liquid level down-hole causes the float to descend vertically, the lower target engages the lower sensing device thereby initiating a decrease in the amount of liquid removed from the well.

The support structure can be a guide that allows the float to move with a surface of the liquid level within the guide.

This invention also provides for a method of producing natural gas from a well including providing a well that produces natural gas and a liquid; providing a pump for removing the liquid from the well; monitoring a liquid level down-hole in the well; adjusting the pump to alter the output of liquid from the well and thereby controlling the liquid level down-hole based on the physical monitoring of the liquid level down-hole in the well; and producing natural gas from the well. Monitoring the liquid level down-hole in the well can be done physically.

The monitoring can be accomplished by a liquid level measurer and adjusting the pump can be done by a signal device connected to the liquid level measurer. The signal device can have a top target connected to the float; a bottom target connected to the float; an upper sensing device connected to an upper support structure so that when the liquid level down-hole causes the float to rise vertically the top target engages the upper sensing device thereby initiating an increase in the amount of liquid removed from the well; and a lower sensing device connected to a lower support structure so that when the liquid level down-hole causes the float to descend vertically the lower target engages the lower sensing device thereby initiating a decrease in the amount of liquid removed from the well. The liquid level measurer can have a support structure and a float connected to the support structure so that it is able to move vertically up and down the support structure and its position is determined by the liquid level down-hole.

The invention also provides for a method for removing oil from a well including providing a well that produces oil; providing a pump for removing oil from the well; monitoring an oil level down-hole in the well; adjusting the pump to alter the output of oil from the well and thereby controlling the oil level down-hole based on the physical monitoring of the oil level down-hole in the well; and producing the oil from the well. Monitoring the oil level down-hole in the well can be done physically.

The monitoring can be accomplished by a liquid level measurer and adjusting the pump can be done by a signal device connected to the liquid level measurer. The signal device can have a top target connected to the float; a bottom target connected to the float; an upper sensing device connected to an upper support structure so that when the oil level down-hole causes the float to rise vertically the top target engages the upper sensing device thereby initiating an increase in the amount of oil removed from the well; and a lower sensing device connected to a lower support structure so that when the oil level down-hole causes the float to descend vertically the lower target engages the lower sensing device thereby initiating a decrease in the amount of oil removed from the well. The liquid level measurer can have a support structure and a float connected to the support structure so that it is able to move vertically up and down the support structure and its position is determined by the oil level down-hole.

The invention also provides for an apparatus that controls the liquid level down-hole of a hydrocarbon producing well having a down-hole sensor that determines a pressure above a pump in a hydrocarbon producing well; a surface pressure sensor that determines the gas within the well bore; and a controller connected to the down-hole pressure sensor, the surface pressure sensor, and the pump wherein the controller calculates and controls the liquid level down-hole by using the down-hole pressure reading and the surface pressure reading to determine the liquid level down-hole and adjusting the pump so that the liquid level down-hole is maintained at a predetermined level.

This invention also provides for an apparatus having an algorithm to calculate the liquid level down-hole that can be: $(y-x)/(sw)=z$, where x=surface pressure, y=down-hole pressure, z=liquid level, and sw=specific weight.

DETAILED DESCRIPTION OF THE INVENTION

Definitions

Figure 1:
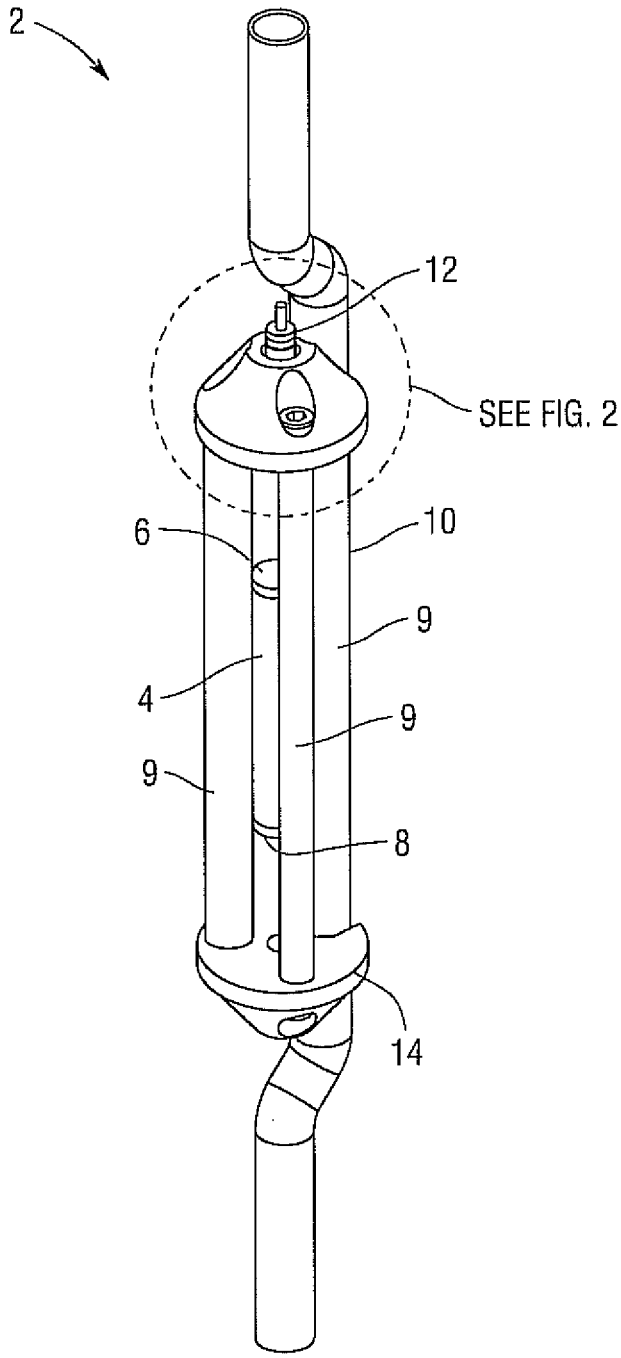
FIG. 1. Shows a perspective view of a down-hole liquid level control.
Figure 2:
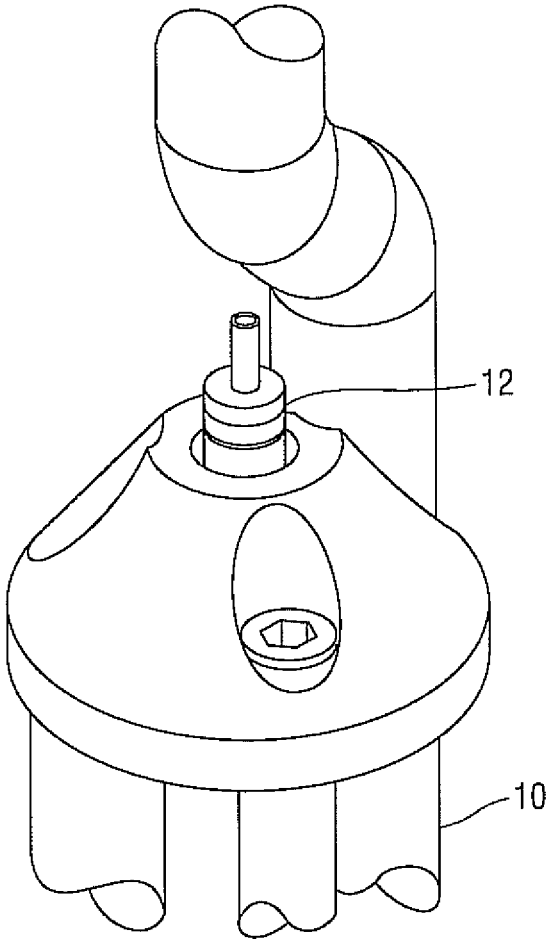
FIG. 2. Shows a perspective view of the upper portion of the support structure.
Figure 3:
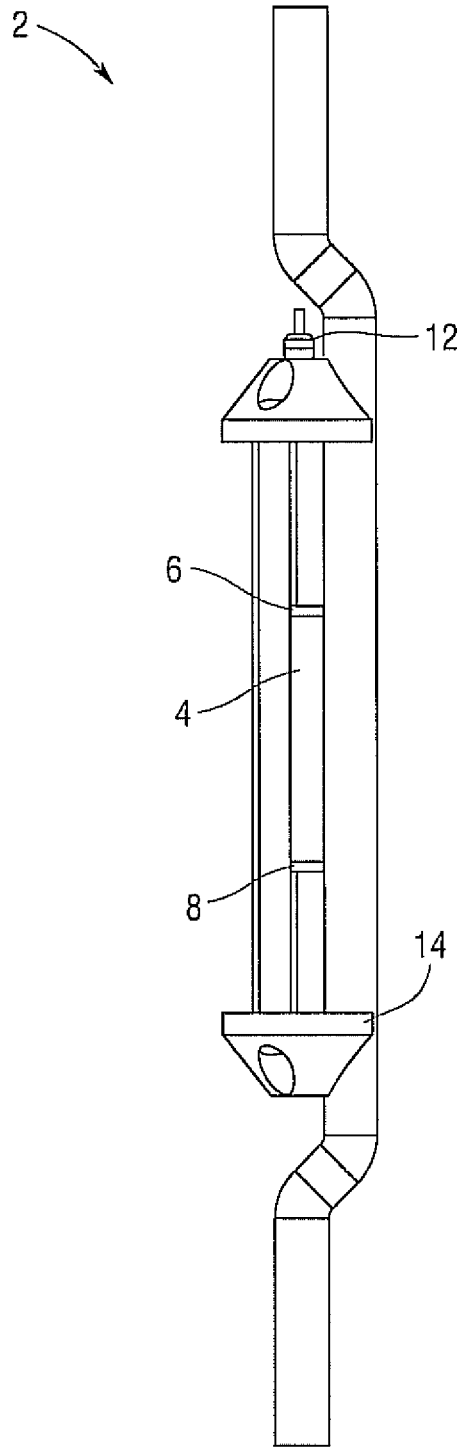
FIG. 3. Shows a side view of the down-hole liquid level control.
Figure 4:
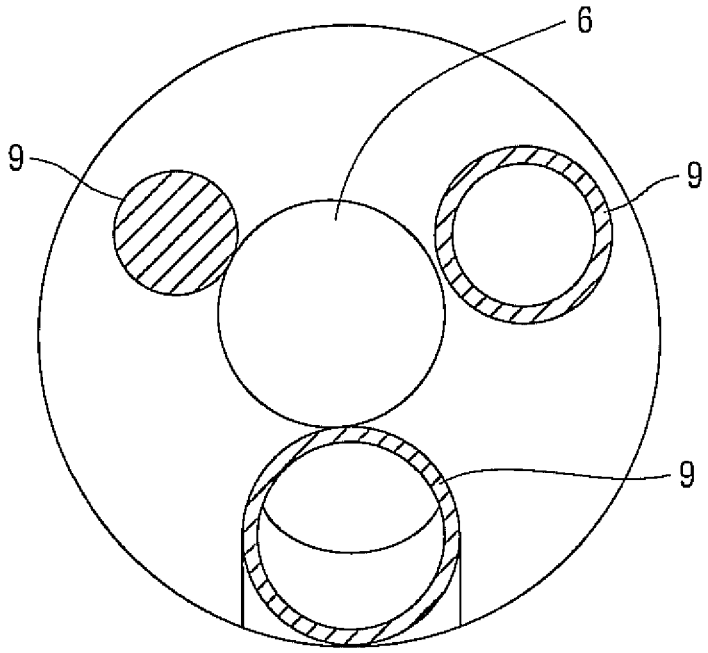
FIG. 4. Shows a top view of the down-hole liquid level control.

"down-hole liquid level measurer"—any device within the well that can measure or indicate the level of liquid inside a well. It can be an instrument that physically measures the vertical depth of the liquid within the well. It can also be a down-hole pressure sensing device that is used in a calculation to determine the liquid level. The down-hole pressure sensing device can be used in combination with a surface pressure sensor.

"physically"—the use of an object that exists in the well bore that moves in relation to or in conjunction with the liquid level.

"monitoring the amount of liquid down-hole in the well"—physically measuring an amount of liquid in the well or level at which the liquid is in the well. It can be just a vertical depth measurement of liquid within the well. It can be done over time as the well conditions change.

"target"—can be anything that activates a controller. A number of examples include a non-contact proximity switching device, special metals detection, radio frequency tagging switch, float switch, magnet sensing switch, pressure transmitter, or proximity switch.

"monitors the liquid level down-hole"—measuring the elevation or depth of liquid in the well over time. This can be a physical measurement using a float. This can be done in a number of different ways including but not limited to, knowing the volumetric capacity of the down-hole pump and the volume between the lowest hydrocarbon producing zone and the top of the pump. If there are 3 barrels of liquid reservoir down-hole between the hydrocarbon producing zone and the pump, and the pump has a volumetric capacity of 3 barrels in 15 minutes, and a high level controller is contacted, you can use a plc or simple timer to turn on the pump for 15 minutes then turn it off and wait for the level controller to signal for it to turn on again. When the pump is on for 15 minutes the liquid level is three barrels less than it was when it was turned on. Another way to measure could be to use pressure sensors. A down-hole sensor would be a pressure sensor. For every vertical foot of head (water level) 0.434 water psig is built (also known as specific weight), so for example, if a pressure sensor was placed at just above the pump, you could stop and start the pump based on the pressure sensor's reading (turn on at 20 psig and turn off at 1 psig=46' and 2' water levels respectively). A surface pressure device would have to be employed to help compensate for natural well pressure. So if there is 200 psig of gas pressure in the well bore you would have to subtract 200 psig from the bottom hole pressure just to get to zero/neutral state.

"hydrocarbon producing well"—well that produces hydrocarbons such as oil and natural gas.

"signal device"—any type of device that can indicate the liquid level and signal for the pump to be turned on and off. This could be a timer, a plc or a control device.

"to signal a pump to turn on/off or slow down or speed up when the liquid is at a certain level"—transmitting to a pump the liquid level thereby causing the pump to turn on or off based on the amount.

"that causes a pump to adjust its current liquid output"—starting the pump, stopping the pump, increasing the pump's rate of removal, or decreasing the pump's rate of liquid removal.

"support structure"—a foundation structure or guide. An example can be seen in FIG. 1 reference no. 9. The structure could be in two pieces or one piece. It could be in two pieces with tubing connecting the two pieces.

"upper support structure"—the top support structure. This could be integral with the lower support structure or separate from the lower support structure.

"lower support structure"—the bottom support structure. This could be integral with the upper support structure or separate from the upper support structure.

"a float"—an object that floats on the surface of the liquid and is used to measure or indicate the liquid level.

"vertically movable up and down in connection with a liquid level"—the ability to move with the liquid level.

"a top target connected to the float"—a target (see definition of target above) that is on the top of the float that is used to indicate that the float has reached a certain vertical height within the well.

"a bottom target connected to the float"—a target (see definition of target above) that is on the bottom of the float that is used to indicate that the float has reached a certain vertical depth within the well.

"an upper sensing device"—any instrument that conveys that the float is at an upper level; it can be an instrument that triggers the opening or closing of an electrical circuit. The upper sensing device can be a proximity switch or other device that has the same ultimate function or a physical switch. The device can contact the target or it can just be in proximity with the target.

"the top target is near the upper proximity indicator"—the proximity indicator is in close physical location with the target.

"sends a signal to turn the pump on"—communicating with the pump so that the pump turns on.

"a lower sensing device"—any instrument that conveys that the float is at a lower level; it can be an instrument that triggers the opening or closing of an electrical circuit. The lower sensing device can be a proximity switch or other device that has the same ultimate function or a physical switch. The device can contact the target or it can just get in proximity with the target.

"sends a signal to turn the pump off"—communicating with the pump so that the pump turns off.

"providing a well that produces natural gas and a liquid"—supplying a well that produces natural gas and a liquid.

"causes the float to rise vertically"—the float moves upward towards the surface of the well or the top of the support structure.

"engages the upper sensing device"—this can be contacting by any means mechanical, electronic, radio waves, etc. It can be physical contact or just close enough contact such as a proximity switch to engage an electrical circuit.

"initiating an increase in the amount of liquid removed from the well"—starting or increasing the rate of liquid removal from the well bore. Typically the pump is used to do this by increasing the output of the pump by either starting the pump or increasing the speed of the pump.

"causes the float to descend vertically"—the float moves downward towards the bottom of the well or the support structure.

"initiating a decrease in the amount of liquid removed from the well"—stopping or slowing the rate of liquid removal from the well bore. Typically the pump is used to do this by decreasing the output of the pump by either stopping the pump or decreasing the speed of the pump.

"providing a pump for removing liquid"—supplying a pump that extracts liquid from the well.

"monitoring the liquid level down-hole in the well"—measuring the level of liquid in the well over time. Measuring the elevation or depth of liquid in the well over time. The measurement occurs in the well. This can be a physical measurement using a float. This can be done in a number of different ways including but not limited to, knowing the volumetric capacity of the down-hole pump and the volume between the lowest hydrocarbon producing zone and the top of the pump. If there are 3 barrels of liquid reservoir down-hole between the hydrocarbon producing zone and the pump, and the pump has a volumetric capacity of 3 barrels in 15 minutes, and a high level controller is contacted, you can use a plc or simple timer to turn on the pump for 15 minutes then turn it off and wait for the level controller to signal for it to turn on again. When the pump is on for 15 minutes the liquid level is three barrels less than it was when it was turned on. Another way to measure could be to use pressure sensors. A down-hole sensor would be a pressure sensor. For every vertical foot of head (water level) 0.434 water psig (this is calculated using the specific weight of water) is built, so for example, if a pressure sensor was placed at just above the pump, you could stop and start the pump based on the pressure sensor's reading (turn on at 20 psig and turn off at 1 psig=46' and 2' water levels respectively). A surface pressure device would have to be employed to help compensate for natural well pressure. So if there is 200 psig of gas pressure in the well bore you would have to subtract 200 psig from the bottom hole pressure just to get to zero/neutral state.

"turning the pump on and off based on monitoring the amount of liquid in the well"—activating the pump when the liquid level reaches a certain point and deactivating the pump when the liquid level gets to a certain point.

"producing the liquid from the well"—removing the liquid from the well.

"natural gas"—a gaseous mixture, consisting mainly of methane, found below ground, used widely as a fuel.

"pump to adjust when the liquid is at a certain level"—to turn on or off or slow down or speed up.

"controls the liquid level down-hole of a hydrocarbon producing well"—regulating the level of the liquid in the well to keep the level at a desired level or desired level range.

"connected"—attached to in any way internally or externally. For example the float can be internal to or within the support structure or it can be external or outside of the support structure, but is attached. It could also be just a means of communication. The liquid level measurer would be considered to be connected to the signal device if the liquid level measurer communicates the liquid level to the signal device in any way or lets the signal device know the liquid level device's location.

"liquid level down-hole"—the vertical measurement of the liquid in the well as measured by the liquid level measurer. This could be the depth or elevation or length of liquid in the well.

"liquid level down-hole as measured by the down-hole liquid level measurer"—the vertical height of the liquid in the well as measured from the bottom of the well by the liquid level measurer.

"so that it is able to move vertically"—allowing for movement up and down perpendicular to horizontal.

"position is determined by the liquid level down-hole"—the float's position within the well and support structure and is dictated by the level of the liquid.

"pump"—any device for removing liquid from a well bore.

"adjusting the pump to alter the output of liquid from the well and thereby controlling the liquid level down-hole"—increasing the speed of the pump, starting the pump, decreasing the speed of the pump, or stopping the pump, to control the amount of liquid being removed and thereby controlling the amount of liquid remaining in the well which can cause the liquid level to rise vertically or descend vertically within the well.

"based on the physical monitoring of the liquid level down-hole in the well"—determining the liquid level in order to adjust it so that it is at a desired level. This is done either to conserve the pump by extending the useful life of the pump or in the case of natural gas to prevent the liquid from having an adverse affect on natural gas production. This also can prevent gas from entering the liquid production system.

"liquid production system"—the equipment including tools and tubing, tanks, liquid pipelines, and petroleum pipelines that are used to remove liquid.

"producing natural gas from the well"—removing natural gas from the well.

"adjusting the pump"—increasing the speed of the pump, starting the pump, decreasing the speed of the pump, or stopping the pump, to control the amount of liquid being removed.

"predetermined level"—can be a position of the liquid along an axis, range of heights, or multiple heights of the liquid level. Examples would be to keep the liquid from between 0 and 50 feet below the formation, keeping the liquid below 10 feet from the formation, or keeping the liquid at 5 feet below the formation.

"oil level down-hole"—the vertical measurement of the oil in the well as measured by the liquid level measurer. This could be the depth or elevation or length of oil in the well.

"initiating an increase in the amount of oil removed from the well"—starting or increasing the rate of oil removal from the well bore. Typically the pump is used to do this by increasing the output of the pump by either starting the pump or increasing the speed of the pump.

"initiating a decrease in the amount of oil removed from the well"—stopping or slowing the rate of oil removal from the well bore. Typically the pump is used to do this by decreasing the output of the pump by either stopping the pump or decreasing the speed of the pump.

"engages the lower sensing device"—this can be contacting by any means mechanical, electronic, radio waves, etc. It can be physical contact or just close enough contact such as a proximity switch to engage an electrical circuit.

"allows the float to move with a surface of the liquid level within the guide"—the float moving in a particular path directed by the guide but in connection with the raising and lowering of the liquid.

"producing natural gas from a well"—removing the natural gas from the well.

"providing a well that produces oil"—any well that produces oil.

"monitoring an oil level down-hole in the well"—measuring the level of oil in the well over time. Measuring the elevation or depth of oil in the well over time. The measurement occurs in the well.

"adjusting the pump to alter the output of oil from the well and thereby controlling the oil level down-hole"—increasing the speed of the pump, starting the pump, decreasing the speed of the pump, or stopping the pump, to control the amount of oil being removed and thereby controlling the amount of oil remaining in the well which can cause the oil level to rise vertically or descend vertically within the well.

"based on the physical monitoring of the oil level down-hole in the well"—determining the oil level in order to adjust it so that it is at a desired level. This is done either to conserve the pump by extending the useful life of the pump or in the case of natural gas to prevent the liquid from having an adverse affect on natural gas production. This also can prevent gas from entering the liquid production system.

"producing the oil from the well"—removing oil from the well.

"down-hole sensor"—a pressure sensing device located within the well. It will preferably be located above the pump and be a submersible pump.

"that determines a pressure above a pump in a hydrocarbon well"—indicating a pressure reached directly above the pump.

"surface pressure sensor"—a pressure sensing device located at or near the surface.

"that determines the gas within the well bore"—pressure above the liquid level down-hole.

"controller"—a plc, which is a programmable microprocessor-based device that is used to control mechanical, electrical and electronic equipment, or a small computer on a single integrated circuit consisting of a relatively simple CPU combined with support functions such as a crystal oscillator, timers, watchdog, serial and analog I/O etc.

"calculates and controls the liquid level down-hole by using the down-hole pressure reading and the surface pressure reading to determine the liquid level down-hole"—using the pressure reading to figure out the liquid level down-hole.

Description

Examples of hydrocarbons are oil and natural gas. When trying to produce oil or natural gas from a well there can be a mixture of gas and liquids in the well. When producing natural gas in a coal bed methane well the goal is to remove water out of the coal seam in order to produce methane gas. If the water level rises above the elevation of the coal seam, gas production can be adversely affected. A pump is used to remove the water so that the water level cannot rise above the coal seams.

The apparatus 2 that controls the liquid level down-hole of a hydrocarbon producing well by monitoring the liquid level down-hole is lowered into a coal bed methane well that has water that needs to be removed. The apparatus 2 can be lowered into the well using Kevlar (or fiberglass or steel—there are several varieties out there now) reinforced plastic pipeline (Polyflow™, Fiberspar™, Flexsteel™), tubing, or pipe. Using the Kevlar reinforced plastic pipeline the apparatus 2 is lowered past the lowest coal seam into a sump which is called the rat hole 28. The rat hole 28 penetrates the lowest coal seam. The rat hole 28 could be a couple hundred feet in depth or elevation. The rat hole 28 is a place for water from the seam to flow into so that it does not interfere with the methane gas production. Coal fines also fall into the rat hole 28 with the water.

The apparatus 2 monitors and controls the level of water in the well so that the level of water does not rise above the coal and also does not allow the pump 16 to operate without water. The controller 24 turns the pump 16 on/off or slows it down or speeds it up at the appropriate times. When the water level is low the pump 16 shuts off so that the pump 16 doesn't pump the well dry. When the water level is at a height near the coal seam, the pump 16 turns on so the water level does not rise to the point where it is adversely affecting gas production.

FIGS. 1-4 show a preferred embodiment of an apparatus 2 including a stainless steel float 4. The float 4 is a down-hole liquid level measurer as it moves in conjunction with the liquid level down-hole to indicate or physically monitor the liquid level. In this embodiment a signal device connected to the liquid level measurer that causes a pump to adjust its current liquid output based on the liquid level down-hole as measured by the down-hole liquid level measurer is made up of:

(a) a top target 6 inside of the float 4;
(b) a bottom target 8 inside of the float 4;
(c) an upper support structure 10;
(d) a lower support structure 11;
(e) an upper sensing device 12; and
(f) a lower sensing device 14.

When the liquid level rises to a point that is determined to be the maximum liquid level, the float 4 will rise within the support structure 9 to the upper support structure 10. The top target 6 is going to cause the upper sensing device 12 to send a signal to either turn the pump 16 on or increase the liquid output of the pump 16. When the pump 16 is turned on or the output level is increased the liquid level down-hole will start to be reduced. As the liquid level down-hole decreases the float 4 will descend within the support structure 9 to the lower support structure 11 and the bottom target 8 will cause the lower sensing device 14 to send a signal to turn the pump off or reduce the liquid output.

The support structure 9 is a guide for the float 10 that allows it to move with the liquid within the guide.

Figure 5:
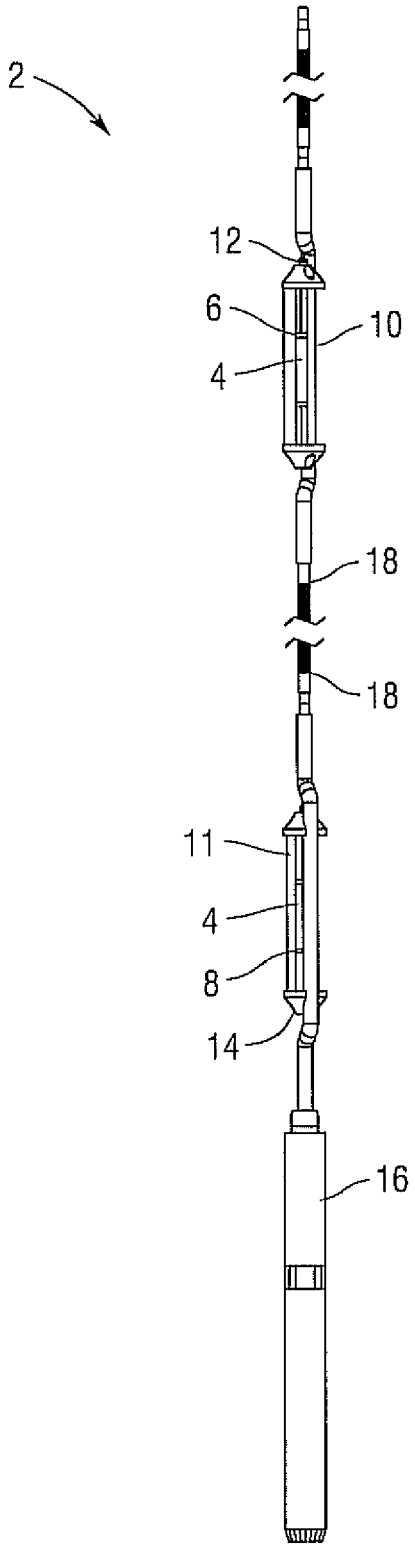
FIG. 5. Shows a side view of a down-hole liquid level control having two floats.

FIG. 5 shows the preferred embodiment where the liquid level measurer of the apparatus 2 is split into two floats 4. The floats are separated by tubing 18. An example of the tubing that can be used is sold under the trademark POLYFLOW owned by PolyFlow, Inc.

This allows for length of the liquid level to be adjusted to any predetermined liquid level range. The length of the physical measurement could be from right below the hydrocarbon formation to a depth of 500 feet. It preferably would be from 5 feet to 40 feet below the hydrocarbon formation. The physical measurement of level can have an overall length measurement of 500 feet or to whatever depth the rat hole is drilled. Typically in a natural gas well the rat hole has a depth of 150 feet which means the liquid level would range from 0 at the bottom of the rat hole to 150 feet at the hydrocarbon producing seam as measured from the bottom of the hole. The measurement could also take place from 0 being at the bottom of the hydrocarbon seam down to 150 feet which is the bottom of the hole. If the rat hole is 150 feet then one could decide whatever maximum and minimum water levels they desire within that range.

In the typical natural gas well one would want the maximum liquid level to reach no higher than within 5 feet of the hydrocarbon formation because they would not want the liquid level to interfere with the natural gas flowing from the hydrocarbon seam. They would want the lowest level to be no more than 50 feet below the hydrocarbon formation so that the pump does not run dry. This could vary from 0 to 500 feet below the hydrocarbon formation depending on the particular well and the circumstances surrounding the drilling of the well and the conditions under which the well produces.

In FIG. 5 the upper sensing device 12 is with the float 4 closest to the hydrocarbon producing seam. If the well is a typical natural gas well the upper sensing device 12 would be placed at 5 feet from the bottom of the hydrocarbon producing seam. When the liquid level rises to a point where the float 4 rises within the upper support structure 10 and causes the top target 6 to engage the upper sensing device 12 the liquid level down-hole has reached the maximum point which in the case of a typical natural gas well it would be within 5 feet from the hydrocarbon seam. Upon engagement of the top target 6 with the upper sensing device 12 the pump 16 adjusts to initiate an increase in the amount of liquid removed from the well. As the pump 16 causes more liquid to be removed from the well the liquid level down-hole starts to decrease or descend. When the liquid level descends to a point that it causes the float 4 to descend within the lower support structure 11 and causes the bottom target 8 to engage the lower sensing device 14 the liquid level down-hole has reached the minimum liquid level which in the case of a typical natural gas well is 45 feet below the hydrocarbon formation. The pump 16 shown in FIG. 5 is a submersible pump.

Figure 6:
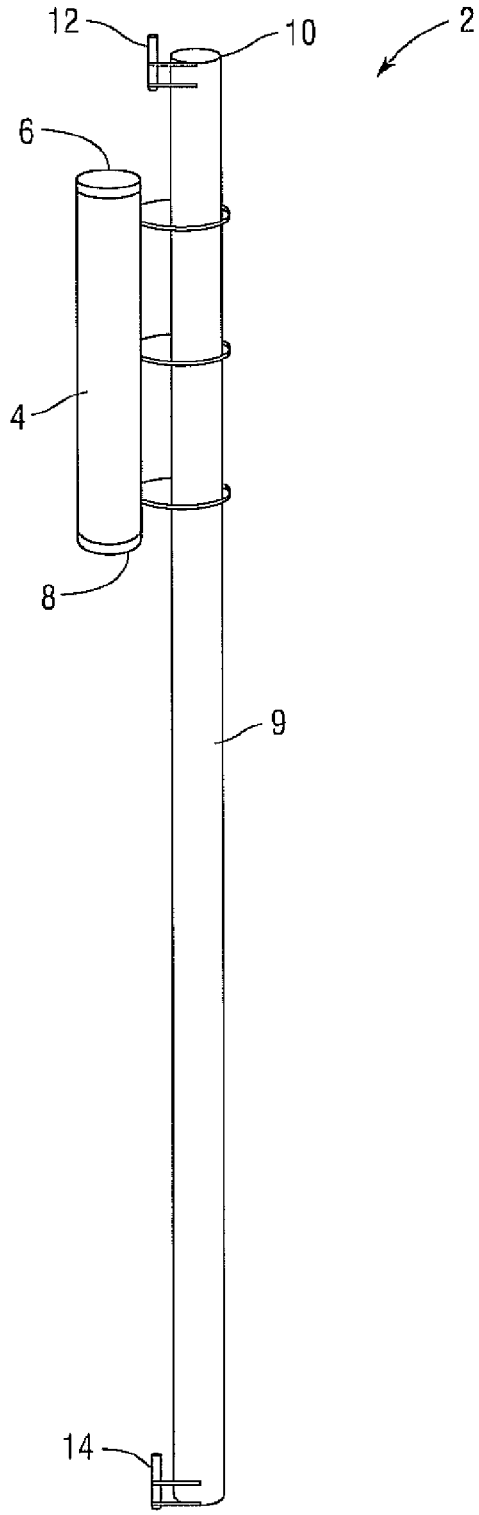
FIG. 6. Shows a side view of a typical well configuration with an upper level control and a lower level control.

FIG. 6 shows an alternate embodiment of the apparatus. In FIG. 6 the float 4 has a top target 6 and a bottom target 8. The support structure 9 is tubing or pipe. The float 4 is connected to the support structure 9 but it is external to the support structure 9. This is in contrast to the preferred embodiment where the float 4 is within the support structure 9.

Figure 7:
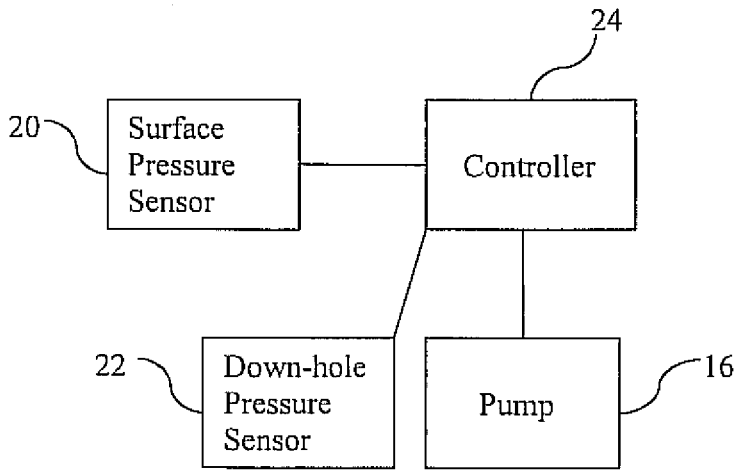
FIG. 7 is a block diagram of the apparatus when it uses a down-hold pressure sensor and a surface pressure sensor.

FIG. 7 shows a block diagram of another embodiment of the invention. In this embodiment a down-hole pressure sensor 22 must be located right above or directly on top of the pump so that it can be used to determine the liquid level down-hole. The down-hole pressure sensor 22 is connected to a controller 24. The controller is also connected to a surface pressure sensor 20 and a pump 16. The controller controls the liquid level down-hole by calculating the liquid level down-hole. This is done using the following formula:

$$\frac{y-x}{sw} = z$$

where:
x=surface pressure
y=down-hole pressure
z=liquid level
sw=specific weight.

The surface pressure is obtained from the surface pressure sensor 20. The down-hole pressure is obtained from the down-hole pressure sensor 22. The specific weight would be programmed into the controller 24 depending on the liquid and its properties.

Example of calculating the liquid level when the liquid is water is as follows:

Down-hole pressure reading=250 lb/in$^2$.
Surface Pressure reading=200 lb/in$^2$.
The specific gravity of water is 62.4 lb/ft$^3$.

$$\frac{y-x}{sw} = z$$

where:
x=surface pressure
y=down-hole pressure
z=liquid level
sw=specific weight.

$$Z = \frac{(250\ \text{lb/sq}^2 - 200\ \text{lb/sq}^2)(12\ \text{in/ft})(12\ \text{in/ft})}{62.4\ \text{lb/ft}^3} = 115\ \text{ft}$$

In order to use the formula to obtain measurements in feet when the pressure is measured in square inches the conversion factor of 144 must be used because there are 12 inches in one foot and 144 inches in one square foot.

Any liquid level could be calculated as long as the specific weight of it is known. The down-hole pressure sensor measurement would qualify under the definition of "physically monitoring" because the pressure sensor is down-hole and has a membrane that changes or moves with respect to the changes in water level.

Another way to look at the pressure calculations is as follows. For every vertical foot of head (water level) 0.434 psig (this is calculated from using specific weight of water) is built, so for example, if a pressure sensor was placed at just above the pump, you could stop and start the pump based on the pressure sensor's reading (turn on at 20 psig and turn off at 1 psig=46' and 2' water levels respectively). A surface pressure device would have to be employed to help compensate for natural well pressure. So if there is 200 psig of gas pressure in the well bore you would have to subtract 200 psig from the bottom hole pressure just to get to zero/neutral state.

Figure 8:
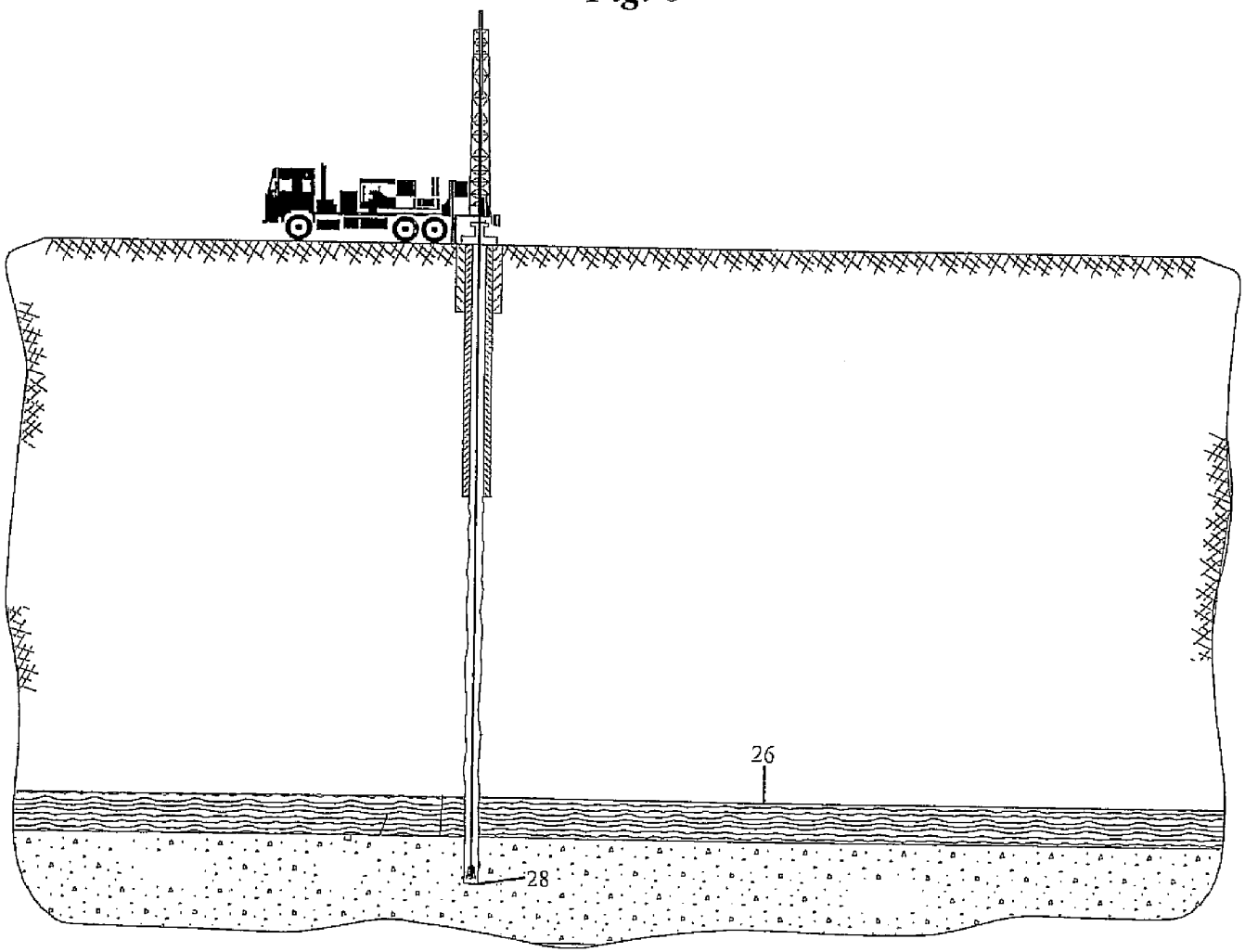
FIG. 8 is a sectional view of a hydrocarbon formation.

FIG. 8 shows a hydrocarbon seam 26. When drilling a well the drill travels through the hydrocarbon seam 26. The portion below the hydrocarbon seam 26 is the rat hole 28. When the hydrocarbon is produced from the hydrocarbon seam 26 the well acts as a separator. The liquid falls into the rat hole while the gas will rise. If the liquid level rises into the hydrocarbon seam 26 then the amount of gas being produced from the seam 26 will be affected. In order to remove the liquid from the well a pump 16 is placed into the rat hole 28 to pump the liquid to the surface.

Alternatively, other emerging technologies could be used to determine the liquid level in the well. One example would be to delineate the distance from a surface sensor to a target floating on the surface of the down-hole produced fluid (see drawings). This target would either emit a timed pulse/frequency/magnetism/ultrasonic/laser that would be received and calculated. The specific on/off or increase or decrease in pump function would be well specific and would be established at the time of completion.

In the event that the floating target malfunctions/sinks it would be imperative that the target frequency could be changed on the surface and a corresponding new target dropped down-hole. This could be performed through RF tagging, the same technology used for the "Speedpass" at a gas pump. The system could be calibrated on the surface or an actual online test could be performed by placing liquid down-hole from the surface.

Another option would be to place a wire down-hole with proximity sensors installed at levels determined at the time of well completion. The same floating target as described above would be utilized. Prior to well service the proximity sensors/wire would need to be reeled out of the well. In the event that the wire is hung, sheer pins could be placed periodically throughout the wire. Lead weights could also be placed throughout the wire so that in the event the cable was severed, the wire and sensors would fall into the rat hole.

Also a one level device and a timer could be used along with other known information to accomplish the claimed method. A sensor would be provided at the maximum liquid level height so that it is known when the liquid level reaches a maximum level. The sensor would respond to the physical movement of the liquid level and would be a down-hole liquid level measurer as well as a signal device. Then a controller or plc would use the volumetric capacity of the down-hole pump and the volume between the lowest coal seam and the top of the pump to determine the duration of the pump's operation. For example, if it is known that there are 3 barrels of liquid reservoir down-hole between the hydrocarbon seam and the pump and that the pump can move 3 barrels in 15 minutes, then 3 barrels are removed from the well in 15 minutes. So once the sensor is contacted a plc or simple timer is programmed to turn on the pump for 15 minutes then turn off. The plc would wait until it receives another signal from the sensor to signal for the pump to turn on again.

The above method and apparatus allows for the liquid level control process to be autonomous without human interaction from a well tender. Additionally, the apparatus and method are very useful for submersible pumps because submersible pumps fly apart when they run dry. If a submersible pump is run without liquid for five minutes it could mechanically destroy itself. Additionally the tubing with the apparatus is better suited for use with a submersible pump. However, the method and apparatus could be used with a sucker-rod pump.

Various changes could be made in the above construction and method without departing from the scope of the invention as defined in the claims below. It is intended that all matter contained in the paragraphs above, as shown in the accompanying drawings, shall be interpreted as illustrative and not as a limitation.

I claim:

1. An apparatus that controls a liquid level down-hole of a hydrocarbon producing well by monitoring the liquid level down-hole in the well comprising:

(a) a down-hole liquid level measurer that is integral to and part of a down-hole tubing in the well;

(b) a signal device connected to the liquid level measurer that causes a pump to adjust the pump's current liquid output based on the liquid level down-hole as measured by the down-hole liquid level measurer;

wherein the down-hole liquid level measurer has a float within a caged support structure, the caged support structure is a unitary structure that both guides the float and protects the float from touching a casing within the well and acts as a section of the down-hole tubing; and wherein the float is contained within the caged support structure so that the float can travel vertically up and down and horizontally within the caged support structure.

2. An apparatus as recited in claim 1 wherein the signal device is a signal device that is not subject to fouling by metal filings.

3. An apparatus as recited in claim 1 wherein the float freely floats within the caged support structure.

4. An apparatus as recited in claim 3 wherein the signal device is a signal device that is not subject to fouling by metal filings.

5. An apparatus as recited in claim 1 wherein the signal device is a signal device that is not subject to fouling by metal filings.

6. The apparatus as recited in claim 1 wherein the caged support structure allows for wire passage from a pump to a surface within internal support structure of the caged support structure so that the wire is not exposed to the well.

7. An apparatus as recited in claim 1 wherein the signal device is a signal device that is not subject to fouling by metal filings.

8. An apparatus as recited in claim 1 wherein the signal device comprises:

(a) a top target connected to the float;

(b) a bottom target connected to the float;

(c) an upper sensing device connected to an upper support structure so that when the liquid level down-hole causes the float to rise vertically, the top target engages the upper sensing device thereby initiating an increase in the amount of liquid removed from the well; and (d) a lower sensing device connected to a lower support structure so that when the liquid level down-hole causes the float to descend vertically, the lower target engages the lower sensing device thereby initiating a decrease in the amount of liquid removed from the well.

9. An apparatus as recited in claim 1 wherein the support structure is a guide that allows the float to move with a surface of the liquid level within the guide.

10. An apparatus that controls a liquid level down-hole of a hydrocarbon producing well by monitoring the liquid level down-hole in the well comprising:

(a) a down-hole liquid level measurer that is integral to and part of a down-hole tubing in the well having:

(i) a float within a caged support structure, the caged support structure is a unitary structure that both guides the float and protects the float from touching a casing within the well and acts as a section of the down hole tubing, the float being contained within the caged support structure without a connecting rod so that the float can travel vertically up and down, horizontally, and tilt on the float's axis;

(b) a signal device that is not subject to being fouled by metal filings connected to the liquid level measurer that causes a pump to adjust the pump's current liquid output based on the liquid level down-hole as measured by the down-hole liquid level measurer.

11. The apparatus as recited in claim 10 wherein the caged support structure allows for wire passage from a pump to a surface within internal support structure of the caged support structure so that the wire is not exposed to the well.

12. A method of producing natural gas from a well comprising:

(a) providing a well that produces natural gas and a liquid;

(b) providing a pump for removing the liquid from the well;

(c) monitoring a liquid level down-hole in the well by providing:

(i) a down-hole liquid level measurer that is integral to and part of a down-hole tubing in the well;

(d) adjusting the pump to alter the output of liquid from the well and thereby controlling the liquid level down-hole based on the physical monitoring of the liquid level down-hole in the well;

(e) producing natural gas from the well;

wherein the down-hole liquid level measurer has a float within a caged support structure, the caged support structure is a unitary structure that both guides the float and protects the float from touching a casing within the well and acts as a section of the down-hole tubing; and wherein the float is contained within the caged support structure so that the float can travel vertically and horizontally within the caged support structure.

13. A method as recited in claim 12 wherein the float freely floats within the caged support structure.

14. A method as recited in claim 12 including adjusting the pump by a signal device that is not subject to being fouled by metal filings connected to the liquid level measurer.

15. A method for removing oil from a well comprising:

(a) providing a well that produces oil;

(b) providing a pump for removing the oil from the well;

(c) monitoring a liquid level down-hole in the well by providing:

(i) a down-hole liquid level measurer that is integral to and part of a down-hole tubing in the well;

(d) adjusting the pump to alter the output of oil from the well and thereby controlling the oil level down-hole based on the physical monitoring of the oil level down-hole in the well;

(e) producing the oil from the well;

wherein the down-hole liquid level measurer has a float within a caged support structure, the caged support structure is a unitary structure that both guides the float and protects it from touching a casing within the well and acts as a section of the down-hole tubing; and wherein the float is contained within the caged support structure so that the float can travel vertically and horizontally within the caged support structure.

16. A method as recited in claim 15 wherein the float freely floats within the caged support structure.

17. A method as recited in claim 15 including adjusting the pump by a signal device that is not subject to being fouled by metal filings connected to the liquid level measurer.

18. An apparatus that controls a liquid level down-hole of a hydrocarbon producing well by monitoring the liquid level down-hole in the well comprising:

(a) a down-hole liquid level measurer that is connected to a down-hole tubing in the well that is used by the pump having:

(i) a float slideably supported and connected to the down hole tubing so that the float can move vertically up and down on the down-hole tubing and wherein the connection to the tubing has space so that the float is capable of horizontal movement; and (b) a signal device that is not subject to being fouled by metal filings connected to the liquid level measurer that causes a pump to adjust the pump's current liquid output based on the liquid level down-hole as measured by the down-hole liquid level measurer.

* * * * *